US005406895A

United States Patent [19]

Suess

[11] Patent Number: 5,406,895

[45] Date of Patent: Apr. 18, 1995

[54] ROOF TRUSS STORAGE SHELF

[76] Inventor: William A. Suess, R.D. 1, Box 109W, Milton, Del. 19968

[21] Appl. No.: 5,811

[22] Filed: Jan. 19, 1993

[51] Int. Cl.[6] ..... A47B 5/00

[52] U.S. Cl. ..... 108/149; 211/86; 211/153

[58] Field of Search ..... 211/183, 86, 153; 248/249, 250, 242; 108/112, 149

[56] References Cited

U.S. PATENT DOCUMENTS

| | | | |
|---|---|---|---|
| 1,363,832 | 12/1920 | Boehmer | 108/149 |
| 2,746,609 | 5/1956 | Welsh | 108/149 |
| 2,969,154 | 1/1961 | Pelletier | 211/119 |
| 3,844,609 | 10/1974 | Bomber | 211/119 |
| 4,074,635 | 2/1978 | Stauble | 108/27 |
| 4,843,975 | 7/1989 | Welsch et al. | 108/24 |
| 4,852,501 | 8/1989 | Olson et al. | 108/111 |

*Primary Examiner*—Kenneth J. Dorner
*Assistant Examiner*—Gerald A. Anderson
*Attorney, Agent, or Firm*—Rhodes & Ascolillo; David L. Baker

[57] ABSTRACT

A storage shelf for storing items in the attic utilizing the roof trusses as supports for the shelves has a first and third support member rotatably connected to a second support member. There may be at least one stabilizing member attached to the first, second or third support member. Along with being rotatably connected to the second support member for adjustability, the first support member and the third support member may be removably connected to the second support member for ease of assembly and replacement. Brackets are used, along with fasteners to attach the shelf to the trusses.

3 Claims, 8 Drawing Sheets

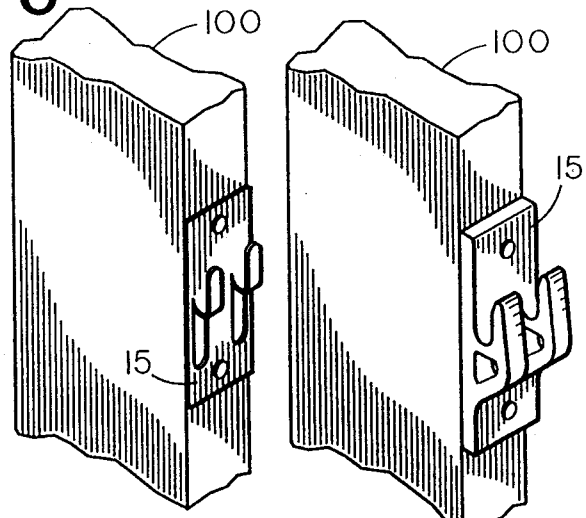
FIG. 6
FIG. 7
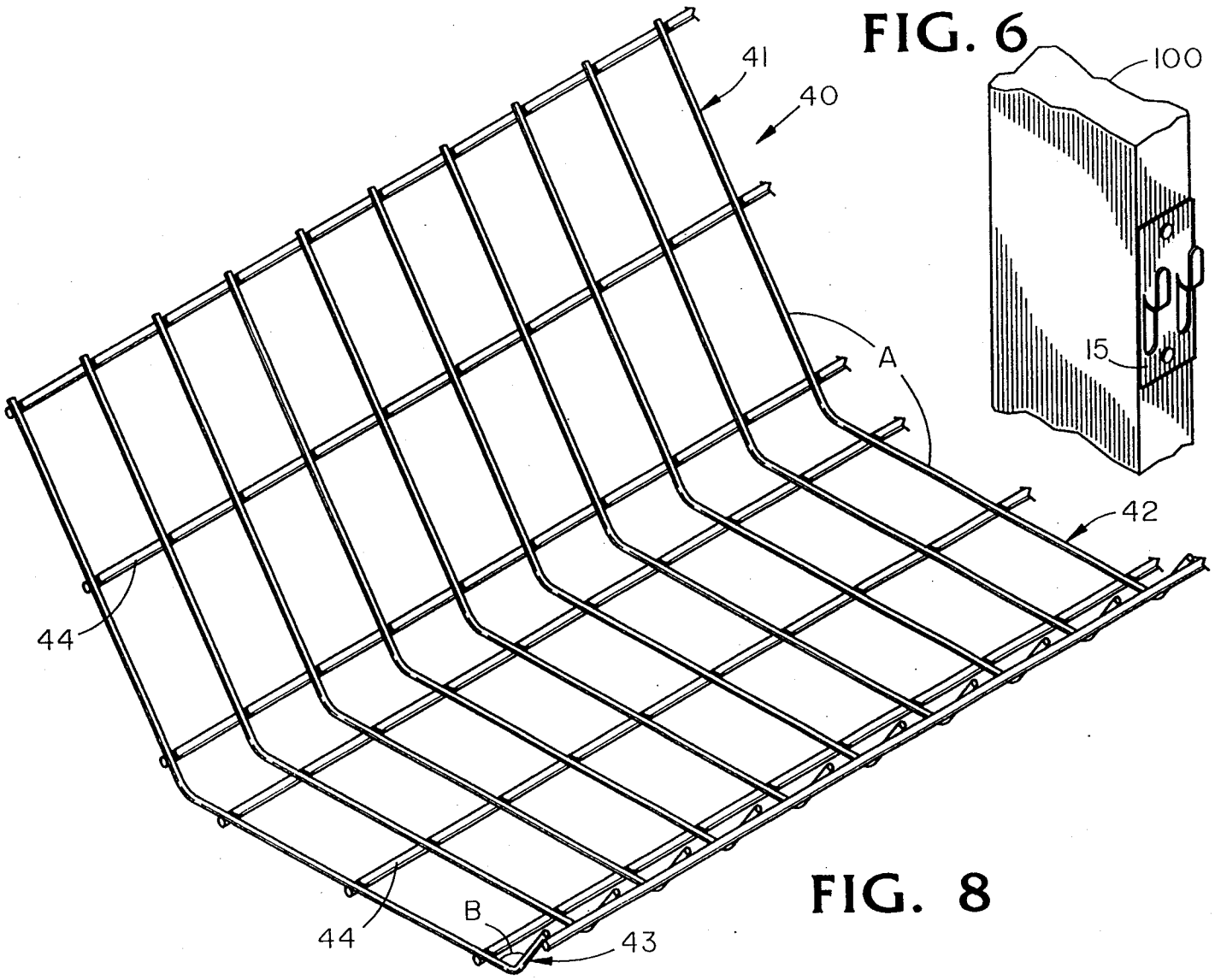
FIG. 8

ROOF TRUSS STORAGE SHELF

BACKGROUND OF THE INVENTION

1. Field of the Invention

This invention relates to a roof truss storage shelf suitable for storing items in the attic or upper storage area of a home or other building.

2. Description of the Related Art

Various types of storage shelves have been developed in the past. But none have taken adequate advantage of the angled trusses found in the attic area of most homes.

U.S. Pat. No. 4,074,635 to A. G. Stauble on Feb. 21, 1978 for a plastic shelf describes an integrally molded, one-piece plastic shelf constructed to be placed on a vertical surface.

U.S. Pat. No. 4,852,501 to R. Olson, et al., on Aug. 01, 1989 for an adjustable rack of shelves shows a set of horizontal shelves placed on notched vertical legs and kept in place by plastic keepers.

U.S. Pat. No. 4,843,975 to J. H. Welsch, et al., on Jul. 04, 1989 for a storage shelf describes a single piece, molded plastic shelf having spaced channels and ribs to allow fluid flow therethrough.

SUMMARY OF THE INVENTION

A problem encountered by homeowners is the lack of efficient storage space. The attic is often used for storing some things. But much of the attic is not suitable for storage of various items due to weight, shape or size. Therefore, much of this space is unused. This invention allows the use of the trusses for storage. The present design is secured in the "Vee" of the trusses and allows for storage in a much more orderly manner.

Described herein in FIG. 3 is a storage shelf 20 having a first support member 21 intimately and angularly abutting a second support member 22. There is at least one first stabilizing member 23 attached to the second support member and may be at least one second stabilizing member (not shown) attached to the first support member. The stabilizing members may not be required on the support members if the support members are suitably rigid.

Another storage shelf 30 shown in FIGS. 1, 2, 4 and 5 has a first support member 31 intimately and angularly abutting a second support member 32 and a third support member 33 intimately and angularly abutting the second support member. There is at least one first stabilizing member 34 attached to the second support member and may be at least one second stabilizing member (not shown) attached to the first support member. The shelf may be made from molded or extruded plastic as shown in FIG. 5 or constructed from sheet metal or any equivalent material as shown in FIG. 4. There may be at least one first fastening port 35 in the first support member and at least one second fastening port 36 in the third support member to fasten the shelf to the trusses 100 utilizing various types of fasteners 37 such as screws, bolts or nails.

In the another embodiment, shown in FIG. 5, the storage shelf 40 has a first support member 41 intimately abutting a second support member 42 at an obtuse angle "A" and a third support member 43 intimately abutting the second support member at an obtuse angle "B". The shelf 40 is made from metal or nonmetal wire frame weldment or perhaps some. equivalent construction such a mesh. In this version, the third support member 43 could be eliminated and the brackets 15 used to attach the second support member 42 to the trusses 100 in the same manner shown in FIG. 13. There is at least one first stabilizing member 44 attached to the second support member, may be at least one second stabilizing member 44 attached to the first support member and may be at least one third stabilizing member (not shown, see FIG. 10 for numeral 18 as example) attached to the third support member. There may be at least one retaining bracket to attach the shelf to the trusses.

It is an object of this invention to provide a roof truss storage shelf to facilitate the storage of assorted items.

BRIEF DESCRIPTION OF THE DRAWINGS

FIG. 6 is a perspective view of a mounting bracket, formed by stamping, for the shelf show in FIG. 8 or 10. The bracket is shown attached to a partial view of a roof truss or other mounting surface.

FIG. 7 is a perspective view of a mounting bracket, formed by extrusion or molding, for the shelf show in FIG. 8 or 10. The bracket is shown connected to a partial view of a roof truss or other mounting surface.

FIG. 8 is a partial perspective view of another embodiment of the shelf showing a construction of metal or non-metal wire frame weldment.

DESCRIPTION OF THE PREFERRED EMBODIMENT

Figure 1:
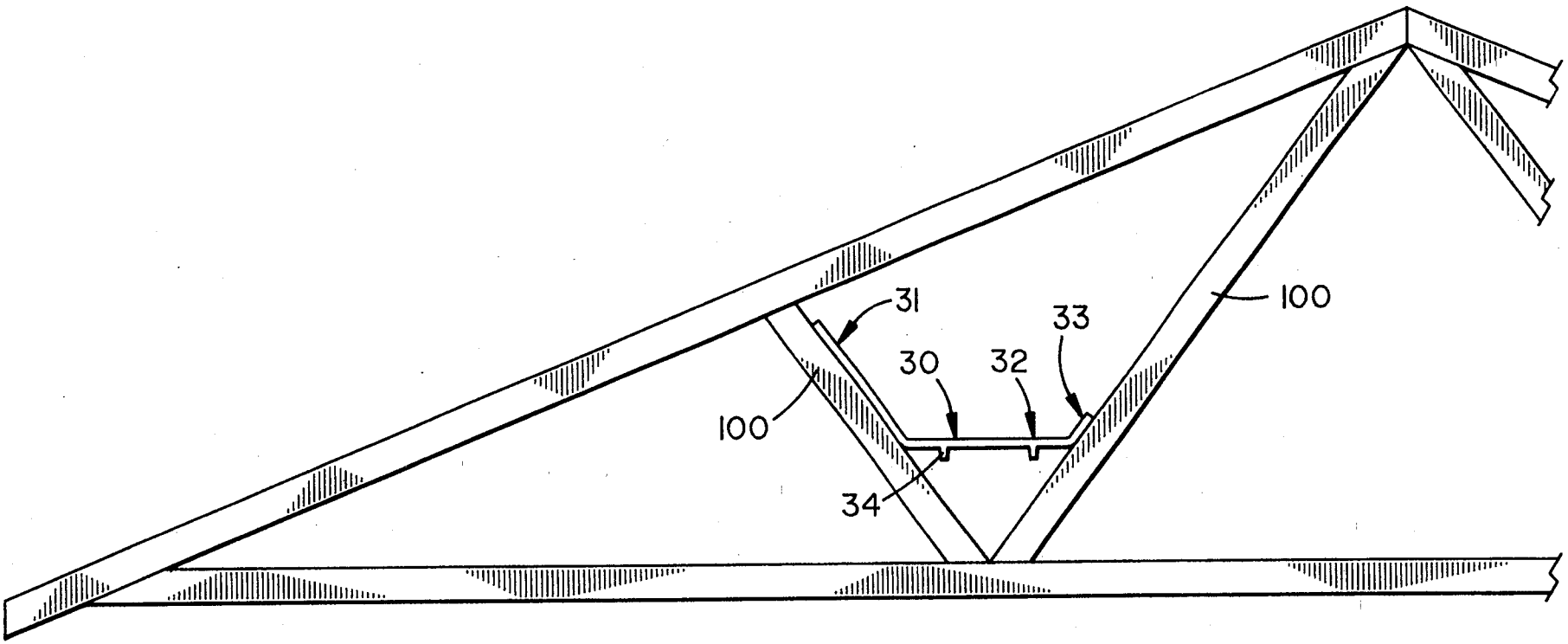
FIG. 1 is right side view of a Roof Truss Storage Shelf shown attached to a partial view of a series of roof trusses or other mounting surfaces.
Figure 2:
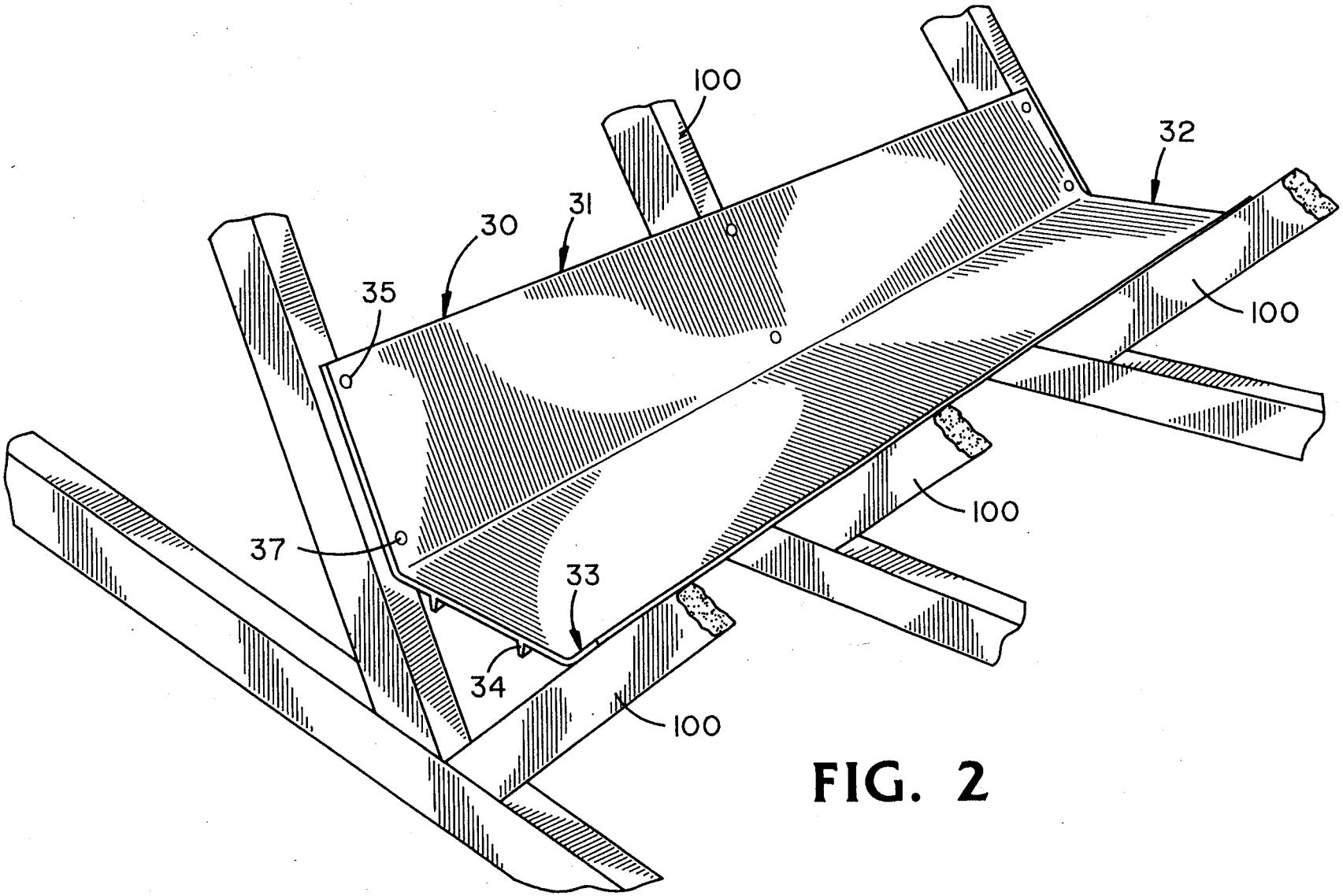
FIG. 2 is a perspective view of the shelf shown attached in a number of roof trusses or other mounting surfaces shown partially depicted.
Figures 3, 4, 5:
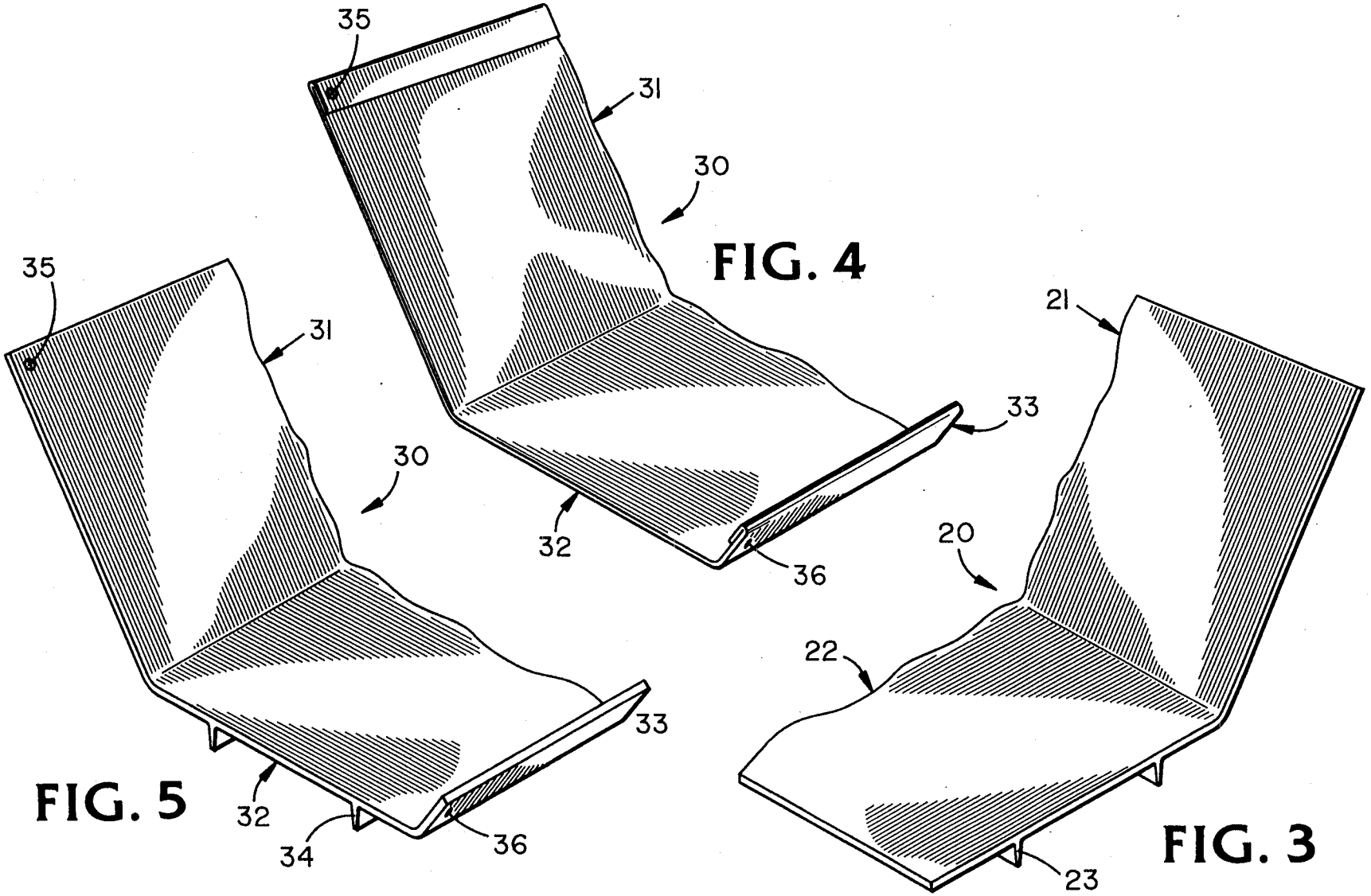
FIG. 3 is a partial perspective view of the shelf showing a construction from a sheet of non-metal and without a third support member.
FIG. 4 is a partial perspective view of the shelf showing a construction from a sheet of metal. This embodiment shows no stabilizing members. Stabilizing members could be utilized for additional rigidity.
FIG. 5 is a partial perspective view of the shelf showing a construction from a sheet of non-metal and having a third support member.
Figure 9:
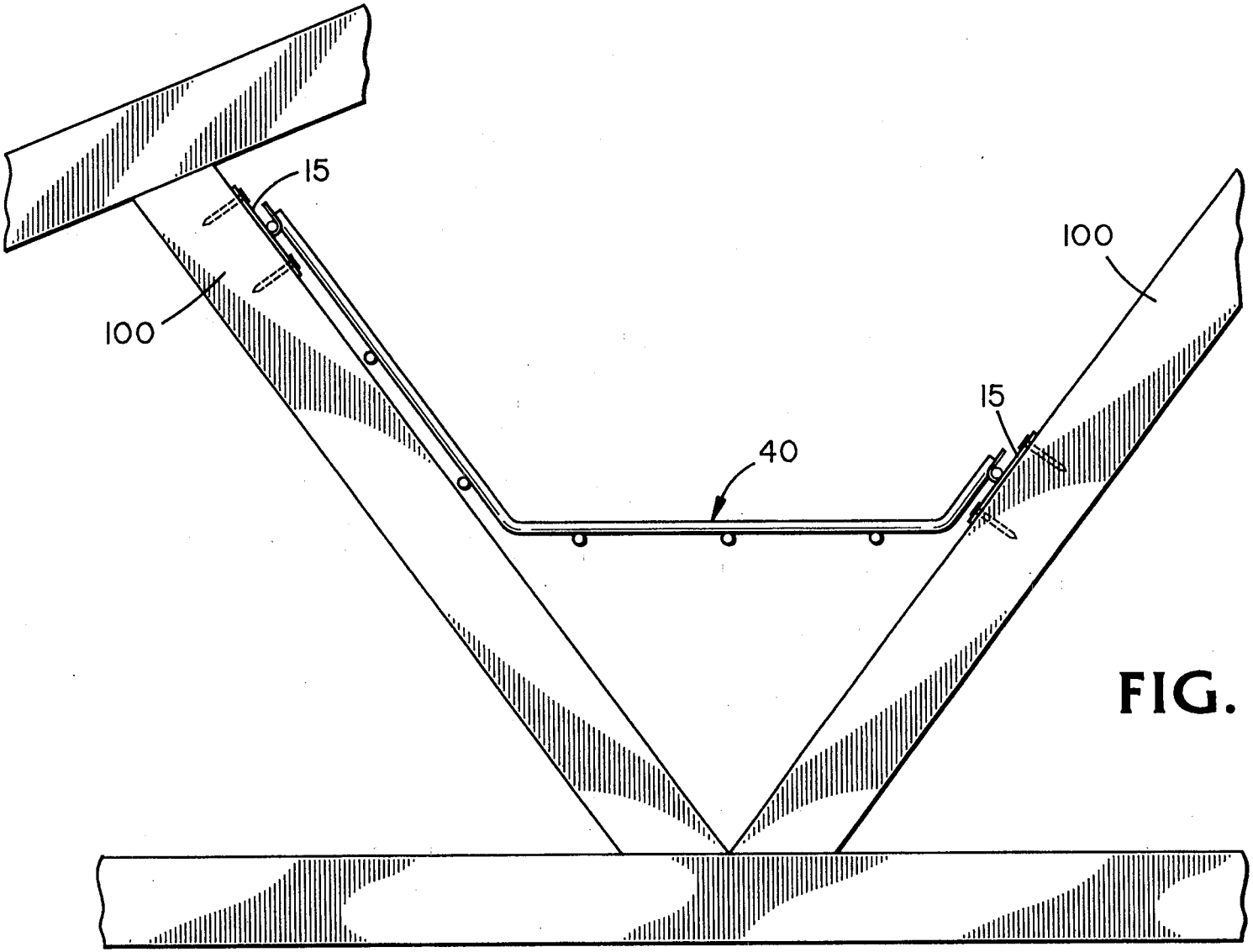
FIG. 9 is left side view of the shelf utilizing the bracket shown in FIG. 6. A mounting surface such as a roof truss is shown in broken lines to better illustrate the manner in which the shelf may be mounted.
Figure 10:
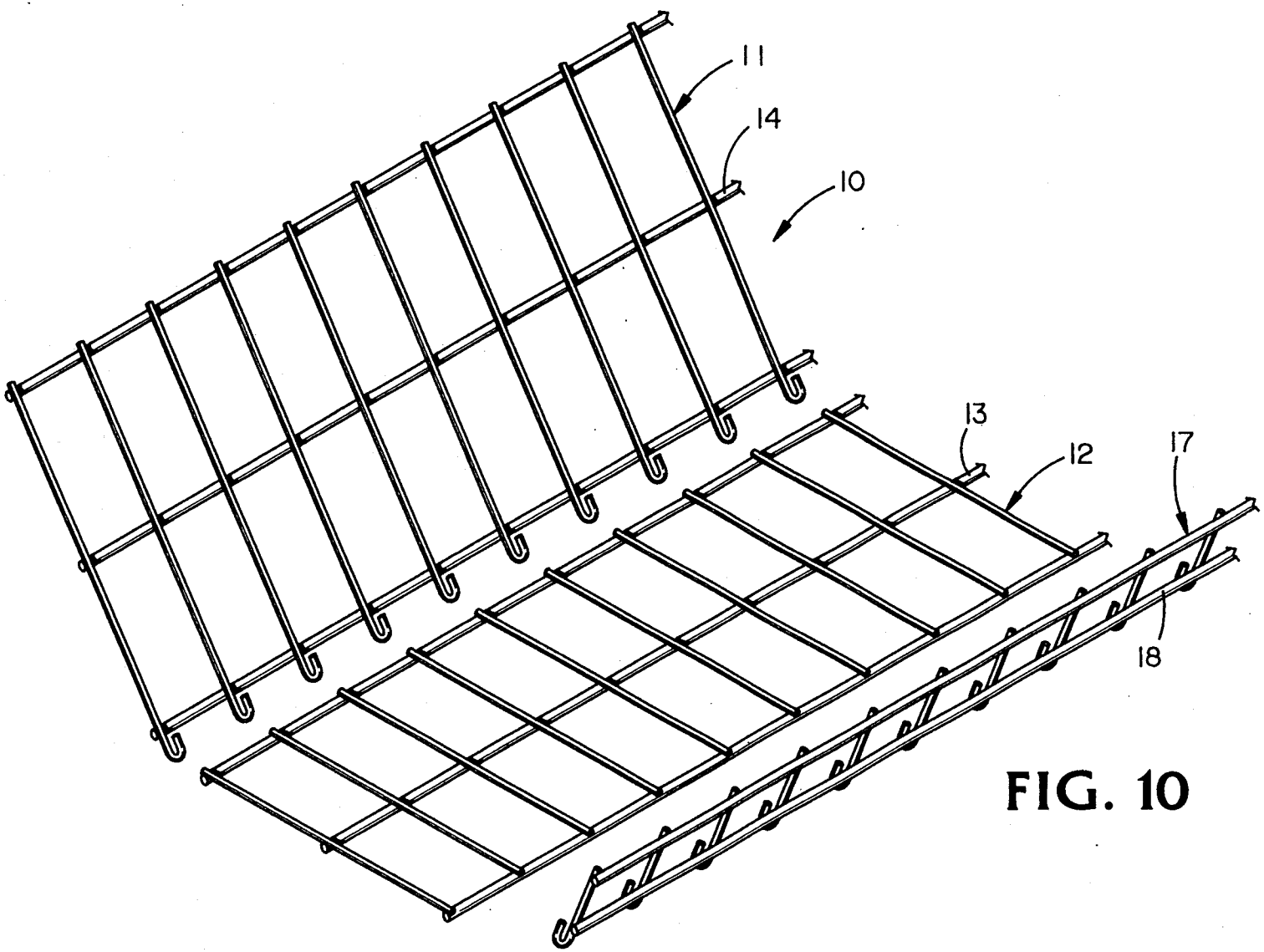
FIG. 10 is an exploded, perspective view of the preferred embodiment of the shelf showing the first, second and third support members ready to be assembled.

FIGS. 10 through 13 show a storage shelf 10 having a first support member 11 rotatably connected to a second support member 12 and at least one first stabilizing member 13 attached to the second support member 12. As an option, there may be at least one second stabilizing member 14 attached to the first support member 11.

To attach the shelf 10 to the roof trusses 100, there may be at least one retaining bracket 15 as shown in FIGS. 6, 7, 9, 11, 12 and 13. The brackets 15 may be attached by any suitable fastening means 16 such as nails, screws or bolts. There may be some installations where the user may prefer not to fasten the shelf to the trusses.

Figure 11:
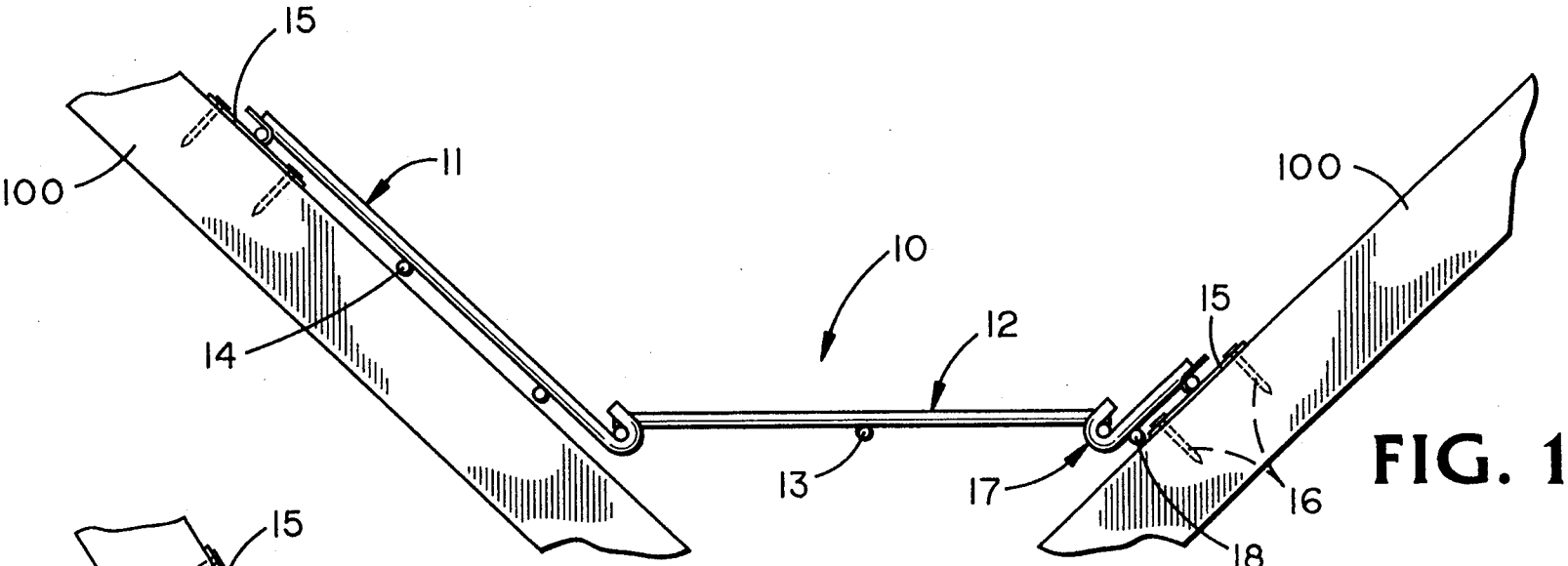
FIG. 11 is a side view of the preferred embodiment shown in FIG. 9 showing the shelf attached to a set of trusses.
Figure 12:
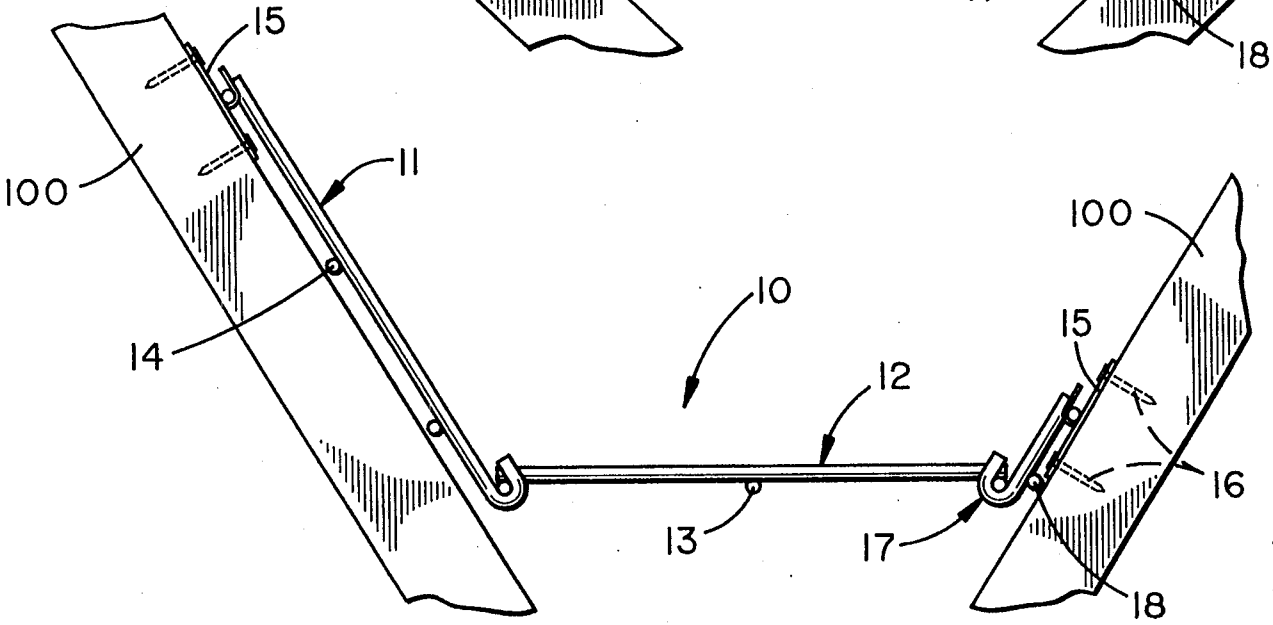
FIG. 12 is a side view of the preferred embodiment shown in FIG. 10 but with the trusses at a different angle to show the flexibility of the shelf to adapt to differently angled trusses.
Figure 13:
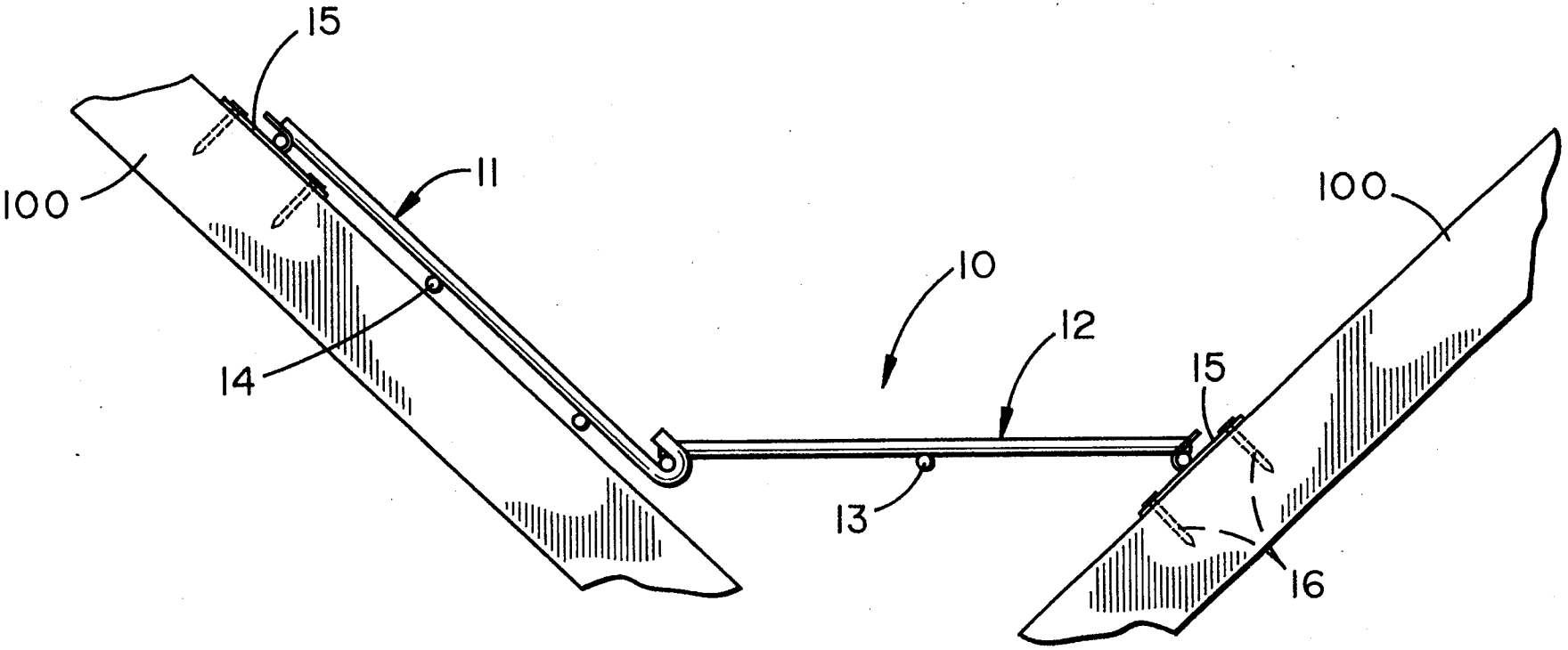
FIG. 13 is a side view of the preferred embodiment wherein the third support member is not used and the second support member is attached to the truss.

There is a third support member 17 rotatably connected to the second support member 12. The brackets 15 may be attached to the second support member and then to the trusses 100 if the third support member is not used as shown in FIG. 13. The brackets 15 may be attached to the third support member 17 and then to the trusses 100 if the third support member 17 is used as shown in FIGS. 11 and 12. For rigidity, at least one third stabilizing member 18 may be attached to the third support member 17.

Along with being rotatably connected, the first support member 11 is removably connected to the second support member 12. The third support member 17 is also be removably and rotatably connected to the second support member 12. This greatly facilitates packing and assembly of the shelf 10. It also allows for easy replacement of a damaged support member after installation. The whole shelf 10 does not need to be replaced if one support member is damaged. The rotatable feature also allows the shelf 10 to be installed on trusses of varying angles to each other as show in FIGS. 10 and 11. The support members and the brackets 15 may be packaged disassembled and assembled at the job site as needed.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. A storage shelf comprising:

(a) a substantially rectangular shaped first support member having a plurality of laterally spaced, J-shaped pieces, said first support member pivotally and removably connected to a substantially rectangular shaped second support member;

(b) at least one first stabilizing member attached to, and running along a longitudinal axis of the second support member;

(c) at least one second stabilizing member attached to, and running along a longitudinal axis of, the first support member;

(d) a substantially rectangular shaped third support member having a plurality of laterally spaced, J-shaped pieces, said third support member pivotally and removably connected to the second support member; and (e) at least one third stabilizing member attached to, and running along a longitudinal axis of, the third support member.

2. A storage shelf as described in claim 1 further comprising at least one retaining bracket.

3. A storage shelf as described in claim 2, wherein a connection of said first and said second support members defines an obtuse angle therebetween, and a connection of said second and said third support members defines an obtuse angle therebetween.

* * * * *